US005130698A

United States Patent [19]

Rauscher

[11] Patent Number: 5,130,698

[45] Date of Patent: Jul. 14, 1992

[54] DEACTIVATABLE ANTI-THEFT SECURITY STRIP

[75] Inventor: Gerd Rauscher, Alzenau, Fed. Rep. of Germany

[73] Assignee: Vacuumschmelze GmbH, Fed. Rep. of Germany

[21] Appl. No.: 660,797

[22] Filed: Feb. 25, 1991

[30] Foreign Application Priority Data

Mar. 10, 1990 [DE] Fed. Rep. of Germany ..... 4007701

[51] Int. Cl.[5] ..... G08B 13/24

[52] U.S. Cl. ..... 340/551; 340/572

[58] Field of Search ..... 340/551, 572; 148/120; 365/133; 428/611

[56] References Cited

U.S. PATENT DOCUMENTS

| | | | |
|---|---|---|---|
| 3,820,090 | 6/1974 | Wiegand | 365/133 |
| 4,591,788 | 5/1986 | Mohri et al. | 148/120 X |
| 4,652,863 | 3/1987 | Hultman | 340/551 |
| 4,660,025 | 4/1987 | Humphrey | 340/572 |
| 4,950,550 | 8/1990 | Radeloff et al. | 428/611 |

FOREIGN PATENT DOCUMENTS

| | | |
|---|---|---|
| 933337 | 3/1981 | Fed. Rep. of Germany . |
| 152008 | 7/1983 | Fed. Rep. of Germany . |

*Primary Examiner*—Donnie L. Crosland
*Assistant Examiner*—Thomas J. Mullen, Jr.
*Attorney, Agent, or Firm*—Hill, Van Santen, Steadman & Simpson

[57] ABSTRACT

A deactivatable anti-theft security strip has a soft-magnetic constituent and a hard-magnetic constituent. The hard-magnetic constituent is used for two purposes. It is used first to stress the soft-magnetic constituent and thereby to promote a fast magnetic reversal, and it is also used to deactivate the strip by magnetization. The pre-stressed, soft-magnetic constituent produces defined, steep pulses even in the presence of a slow magnetic reversal, so that the anti-theft security strip is especially suited for alternating fields having low frequencies, for example 50 or 60 Hz.

6 Claims, 2 Drawing Sheets

DEACTIVATABLE ANTI-THEFT SECURITY STRIP

BACKGROUND OF THE INVENTION

1. Field of the Invention

The present invention is directed to a deactivatable anti-theft security strip of the type used in security systems making use of an alternating filed to detect the unauthorized removal of articles to which the security strip is attached.

2. Description of the Prior Art

Security systems are known which make use of an alternating field in an examination zone, such as at an exit of a store, with all articles in the secured area having an anti-theft security strip attached thereto, the strip becoming magnetically reversed in the alternating field in the examination zone and consequently causing the generation of pulses having characteristic harmonics in a reception coil. Such strips are known which consist of an elongated composite member having a soft-magnetic constituent and a hard-magnetic constituent, with the two constituents forming the composite member being in mechanical contact so that each constituent mechanically supports the other.

Such an anti-theft security strip is disclosed in German OS No. 29 33 337. This strip is formed by a ferromagnetic wire having two layers supported relative to each other. The magnetically hard, interior layer consists, for example, of a Fe-Co-V alloy which is exteriorly surrounded by a second constituent consisting of soft steel, Cu, Ni, Al or brass.

A number of manufacturing techniques for such composite wires or composite strips are disclosed, for example, in German Patent No. 31 52 008. The use of an elongated magnetic switch core is disclosed therein, the core having a circular or angular cross section and typically being magnetically reversed in the presence of a discontinuous field strength of approximately 15 A/cm.

German OS NO. 38 24 075 discloses a composite element which is specifically optimized for use in anti-theft security systems. The composite element is referred to as a pulse wire, and is formed by a core and sheath of two respectively different magnetic materials. The hard-magnetic sheath is magnetized in the activated condition. When the pulse wire proceeds into the alternating field of an examination zone, the soft-magnetic core is suddenly magnetically reversed at every other half-wave of the alternating field.

The magnetized, hard-magnetic sheath diminishes the demagnetization tendencies at the end of the pulse wire so that relatively short wires can be used, however, this means that the amplitude of the alternating field must be high enough to overcome the pre-magnetization of the hard-magnetic sheath. In this known pulse wire, the response field strength also therefore lies at approximately 15 A/cm.

An elongated pulse wire having a low response field strength of approximately 0.8 A/cm is disclosed in U.S. Pat. No. 4,660,025. The pulse wire disclosed therein is a wire consisting of amorphous metal which, due to the nature of its manufacture, has internal stresses and therefore experiences a fast magnetic reversal, the fast magnetic reversal being due at least in part to the internal stresses.

SUMMARY OF THE INVENTION

It is an object of the present invention to provide an anti-theft security strip which undergoes an magnetic reversal in the presence of a relatively low field strength, and which is deactivatable without the attachment of permanent magnetic materials to the strip.

In the security strip disclosed herein, in contrast to known security strips, the hard-magnetic constituent performs two functions. First, the hard-magnetic constituent is used to cause a defined prestressing of the soft-magnetic material. Second, the strip can be deactivated by magnetizing the hard-magnetic constituent.

The hard-magnetic constituent of the inventive anti-theft security strip is demagnetized in the activated condition, the soft-magnetic constituent has a coercivity field strength which is below the field strength of the alternating field in the examination zone, and the hard-magnetic constituent has a coercivity field strength which is above the field strength of the alternating field in the examination zone.

As in known security strips, the interior portion of the composite member may be in the form of a wire or strip having a rectangular cross section, with the outer portion surrounding the core. Usually the core is the soft magnetic constituent and the hard-magnetic constituent concentrically surrounds the core so that the two constituents can be drawn together and thus formed as a unit. If the core of the security strip has a rectangular cross section, the exterior portion can be connected to the core by rolling the hard-magnetic constituent onto the core at both sides, and by annealing at a temperature preferably higher than 1000° C.

DESCRIPTION OF THE PREFERRED EMBODIMENTS

Figure 1:
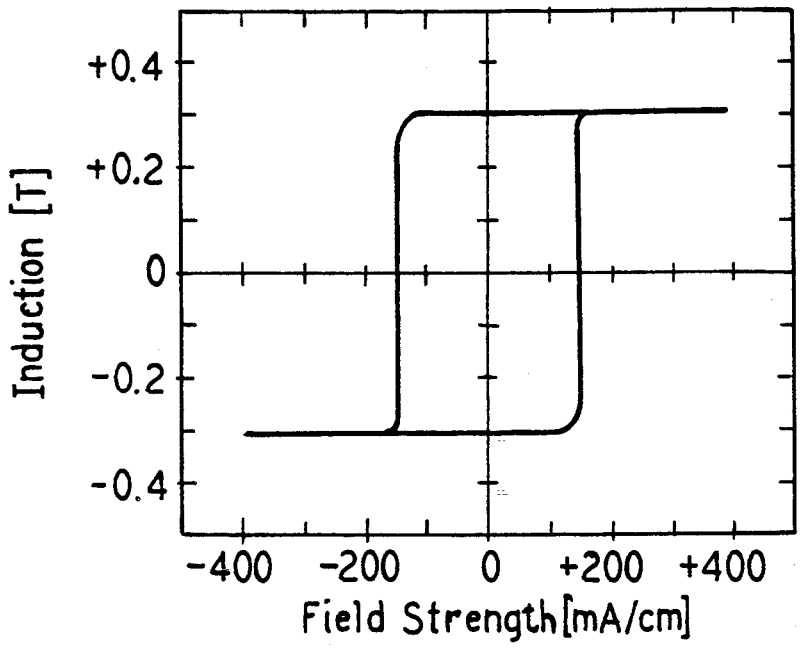
FIGS. 1 and 2 are magnetization curves for a wire having a soft-magnetic inner constituent and a hard-magnetic outer constituent constructed in accordance with the principles of the present invention.

A magnetization curve is shown in FIG. 1 for an anti-theft security strip constructed in accordance with the principles of the present invention have a soft-magnetic inner constituent and a hard-magnetic outer constituent. The induction is shown on the ordinate in Tesla given low modulation, i.e., given field strengths of +400 mA/cm through −400 mA/cm. As can be seen from the curve of FIG. 1, the coercivity field strength of the wire lies at approximately 0.17 A/cm, so that fields beginning at 0.2 A/cm already cause a magnetic reversal of the soft-magnetic part, and can thus cause an alarm to be triggered in the examination zone.

Figure 2:
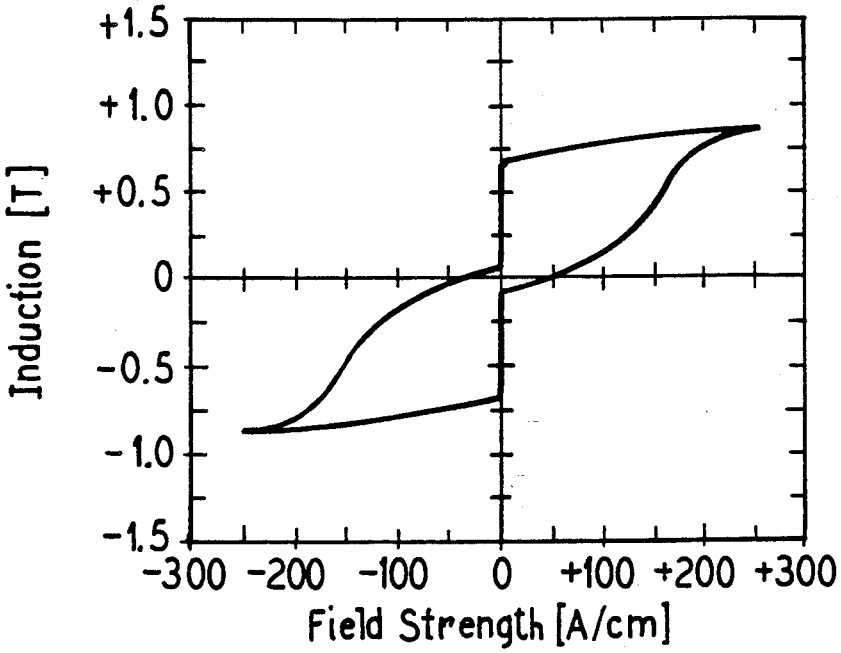

The magnetization loop of the same composite member is shown in an enlarged scale in FIG. 2. It can be seen from FIG. 2 that field strengths above 200 A/cm are required for the complete magnetization of the hard-magnetic constituent, and that changes in the magnetic field of the hard-magnetic constituent are only identifiable at all given magnetic field of more than 10 A/cm.

Given an alternating field of between 0.2 and 10 A/cm in the examination zone, therefore, a reliable magnetic reversal of the soft-magnetic part will occur with the frequency of the alternating field without a change in the magnetization of the hard-magnetic constituent occurring.

The defined mechanical prestress of the soft-magnetic constituent, which can be set using manufacturing parameters (selection of material, tempering and annealing treatments), insures a defined Barkhausen effect in the magnetic reversal, so that voltage pulses having a steep edge are produced. It is desirable to produce voltage pulses having a steep edge because this insures that a large number of evaluatable harmonics, characteristic for the security strip, will be present given relatively slow field changes (for example, 50 Hz) of the alternating field.

In the manufactured state of the anti-theft security strip, the hard-magnetic constituent is always demagnetized, and therefore the strip is in the active condition, because during manufacture annealing will take place above the Curie temperature. If for some reason the Curie temperature is not exceeded during manufacture, the strip would have to be demagnetized by the application of an alternating field having decreasing amplitude in order to place the security strip in the active condition. It is sufficient for deactivation to bring the anti-theft security strip into contact with sufficiently strong magnets having alternating polarity.

Because, in contrast to the strip disclosed in German OS No. 38 24 075, the demagnetizing boundary phenomena are not prevented in the security strip disclosed herein by magnetized permanent magnetic material, it is necessary to provide a minimum length of the strip, dependent on the cross section of the soft-magnetic part. For this purpose, it has been found that the length in millimeters should be more than approximately 4000 times the cross section in square millimeters. For example, an anti-theft security strip having a length of slightly more than 30 mm or greater can be employed if the diameter of the soft-magnetic part is less than or equal 0.1 mm.

Figure 3:
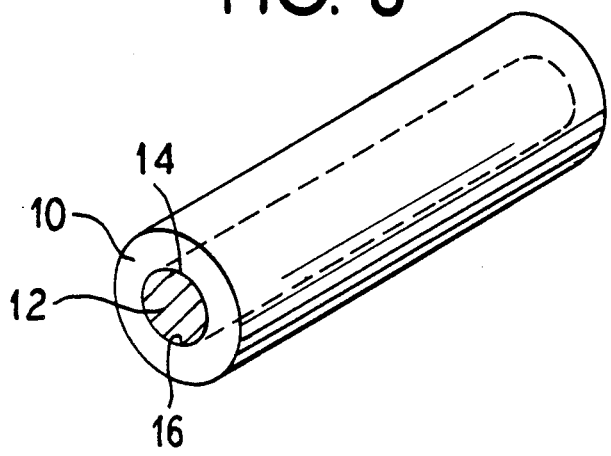
FIG. 3 illustrates an exemplary embodiment of a wire having soft and hard-magnetic constituents constructed in accordance with the principles of the present invention.

FIG. 3 illustrates an exemplary embodiment of a wire having a hard-magnetic constituent 10 and a soft magnetic constituent 12. The hard-magnetic constituent 10 and soft magnetic constituent 12 are formed into a composite elongated member. The hard-magnetic constituent 10 and soft magnetic constituent 12 mechanically support one another. The hard-magnetic constituent 10 is demagnetized in an activated condition of the security strip. The soft magnetic constituent 12 has a coercivity field strength which is below the field strength of the alternating field in the examination zone. The hard-magnetic constituent 10 has a coercivity field strength which is higher than the field strength of the alternating field in the examination zone. The hard-magnetic constituent 10 is disposed at an exterior 14 of the elongated member, and the soft magnetic constituent 12 is disposed in an interior 16 of the elongated member. The composite member can also be formed of a wire consisting of the soft magnetic constituent 10 disposed inside a tube consisting of the hard-magnetic constituent 12.

Figure 4:
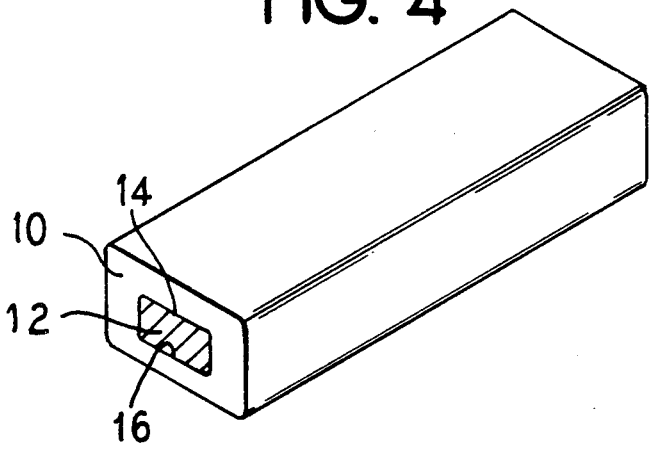
FIG. 4 illustrates an exemplary embodiment of a foil having hard and soft magnetic constituents constructed in accordance with the present invention.

FIG. 4 illustrates an exemplary embodiment of a foil including the soft magnetic constituent 12 and hard-magnetic constituent 10 formed into a composite elongated member. The soft magnetic constituent 12 and the hard-magnetic constituent 10 mechanically support one another. The hard-magnetic constituent 10 is demagnetized in an activated condition of the security strip. The soft magnetic constituent 12 had a coercivity field strength which is below the field strength of the alternating field in the examination zone. The hard-magnetic constituent 10 has a coercivity field which is higher than the field strength of the alternating field in the examination zone. The hard-magnetic constituent 10 can be disposed at the exterior 14 of the elongated member, and the soft magnetic constituent 12 can be disposed in the interior 16 of the elongated member.

Figure 5:
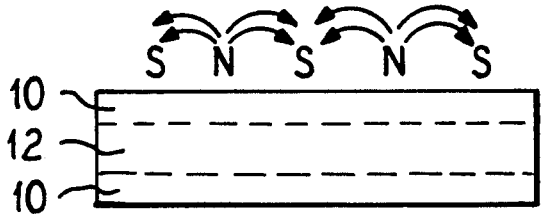
FIG. 5 illustrates the magnetization of the hard-magnetic constituent of the security strip.

FIG. 5 illustrates the magnetization of the hard-magnetic constituent 10 for deactivation of the security strip, wherein deactivation of the security strip is undertaken by sections having different polarities.

The hard and soft and magnetic constituents, 10, 12, mechanically support each other as illustrated in FIGS. 3 and 4 respectively. For example, where the core is the soft magnetic constituent 12 and the hard-magnetic constituent 10 centrally surrounds the core, the two constituents can be drawn together and thus formed as a unit, as illustrated in FIG. 3. Further, if the core of the security strip has a rectangular cross section, the exterior portion can be connected to the core by rolling the hard-magnetic constituent 10 onto the core at both sides, and by annealing at a temperature preferably higher than 1000° C.

A deactivatable anti-theft security strip manufactured in accordance with the principles of the present invention results in a defined Barkhausen effect in the magnetic reversal of the deactivatable anti-theft security strip.

Although modifications and changes may be suggested by those skilled in the art, it is the intention of the inventor to embody within the patent warranted hereon all changes and modifications as reasonably and properly come within the scope of his contribution to the art.

I claim as my invention:

1. A deactivatable anti-theft security strip which is magnetically reversible in an alternating field of an examination zone thereby to generate pulses having characteristic harmonics in a reception coil, said security strip comprising:

a soft-magnetic constituent and a hard-magnetic constituent formed into a composite elongated member with the soft-magnetic and hard-magnetic constituents mechanically supporting each other;

said hard-magnetic constituent being demagnetized in an activated condition of said security strip;

said soft-magnetic constituent having a coercivity field strength which is below the field strength of the alternating field in the examination zone; and said hard-magnetic constituent having a coercivity field strength which is higher than the field strength of the alternating field in the examination zone, whereby a defined Barkhausen effect is achieved in the magnetic reversal at said deactivatable anti-theft security strip.

2. A deactivatable anti-theft security strip as claimed in claim 1 wherein said hard-magnetic constituent is magnetized for deactivating the anti-theft security strip.

3. A deactivatable anti-theft security strip is claimed in claim 2 wherein said magnetization of said hard-magnetic constituent for deactivation of said security strip is undertaken by a plurality of sections with different polarities.

4. A deactivatable anti-theft security strip as claimed in claim 1 wherein said elongated composite member has a length in millimeters which is at least approximately 4000 times as large as the cross section of the soft magnetic constituent in square millimeters.

5. A deactivatable anti-theft security strip as claimed in claim 1 wherein said hard-magnetic constituent is disposed at an exterior of said elongated member, and said soft-magnetic constituent is disposed in the interior of said elongated member.

6. A deactivatable anti-theft security strip as claimed in claim 1 wherein said composite member is formed by a wire consisting of said soft-magnetic constituent disposed inside a tube consisting of said hard-magnetic constituent.

* * * * *